US005884455A

United States Patent [19]

Draghetti et al.

[11] Patent Number: 5,884,455

[45] Date of Patent: Mar. 23, 1999

[54] PRODUCT WRAPPING METHOD

[75] Inventors: Fiorenzo Draghetti, Medicina; Mino Cesari, Granarolo Dell'Emilia; Mario Turra, Casalecchio Di Reno, all of Italy

[73] Assignee: G.D Societa' Per Azioni, Bologna, Italy

[21] Appl. No.: 816,638

[22] Filed: Mar. 13, 1997

[30] Foreign Application Priority Data

Mar. 15, 1996 [IT] Italy ..... B096 A 000141

[51] Int. Cl.[6] ..... B65B 11/06; B65B 51/00

[52] U.S. Cl. ..... 53/466; 53/141; 53/387.2; 156/273.1

[58] Field of Search ..... 53/466, 461, 141, 53/416, 476, 396, 228, 230, 285, 375.8, 387.2, 387.1, 586; 156/273.1, 274.4, 274.6

[56] References Cited

U.S. PATENT DOCUMENTS 3,784,711 1/1974 Kane ..... 156/273.1 X
4,182,222 1/1980 Stahl ..... 156/273.1 X
4,419,855 12/1983 Shanklin ..... 53/450
4,782,647 11/1988 Williams et al. ..... 53/141 X
4,945,709 8/1990 Cerf ..... 53/141 X
5,116,444 5/1992 Fox ..... 156/273.1 X
5,156,712 10/1992 Post ..... 156/273.1 X
5,199,246 4/1993 Rodrigo ..... 53/141 X

*Primary Examiner*—James F. Coan
*Attorney, Agent, or Firm*—Ladas & Parry

[57] ABSTRACT

A method of overwrapping a product having an outer wrapping of dielectric material; the method providing for feeding a sheet of dielectric overwrapping material past an opening of a passage for the product; feeding the product into engagement with the sheet and subsequently, together with the sheet, through the passage to fold the sheet into a U about the product; and stabilizing the sheet so folded by feeding the sheet and the product through an electric field.

10 Claims, 2 Drawing Sheets

PRODUCT WRAPPING METHOD

BACKGROUND OF THE INVENTION

The present invention relates to a product wrapping method.

More specifically, the present invention relates to a method of overwrapping, by means of a sheet of dielectric material, a product made at least externally of dielectric material, e.g. a product having an outer wrapping made of dielectric material.

The present invention is particularly advantageous for use on overwrapping machines, in particular machines for cellophaning packets or cartons of cigarettes, to which the following description refers purely by way of example.

On cellophaning machines of the above type, a sheet of transparent synthetic material, normally a sheet of polypropylene, is folded into a U about each product, comprising a carton or packet of cigarettes, so that two opposite portions of the sheet project beyond the product; which portions are subsequently folded one on top of the other on the product to form a tubular wrapping, which is completed by stably connecting the two portions to each other.

A major problem when designing cellophaning machines of the above type is ensuring each U-folded sheet adheres perfectly to the product for as long as it takes to fold and connect the projecting portions, and without damaging either the sheet or the product.

SUMMARY OF THE INVENTION

It is an object of the present invention to provide a method designed to eliminate the above problem.

According to the present invention, there is provided a method of wrapping a product made at least externally of dielectric material, the method comprising the step of folding a sheet of dielectric wrapping material into a U about said product, and being characterized by comprising a stabilizing step for stabilizing the sheet in the U-folded position; said stabilizing step being performed by generating an electrostatic force of attraction between the sheet and an outer surface of the product.

Said force is preferably generated by forming a first given distribution of electric charges on said sheet, and a second distribution of charges of opposite sign on the outer surface of the product.

According to a preferred embodiment of the above method, said distributions of electric charges are formed by induction, by placing the product and the sheet inside an electric field; said first distribution of charges being formed on an inner surface of the sheet.

According to a further preferred embodiment of the above method, said distributions of electric charges are formed by depositing charges on said sheet; said first distribution of charges preferably being formed on an outer surface of said sheet.

BRIEF DESCRIPTION OF THE DRAWINGS

A non-limiting embodiment of the present invention will be described by way of example with reference to the accompanying drawings, in which:

FIGS. 1A and 1B are enlarged details in FIG. 1;

DETAILED DESCRIPTION OF THE INVENTION

Figures 1, 1A, 1B:
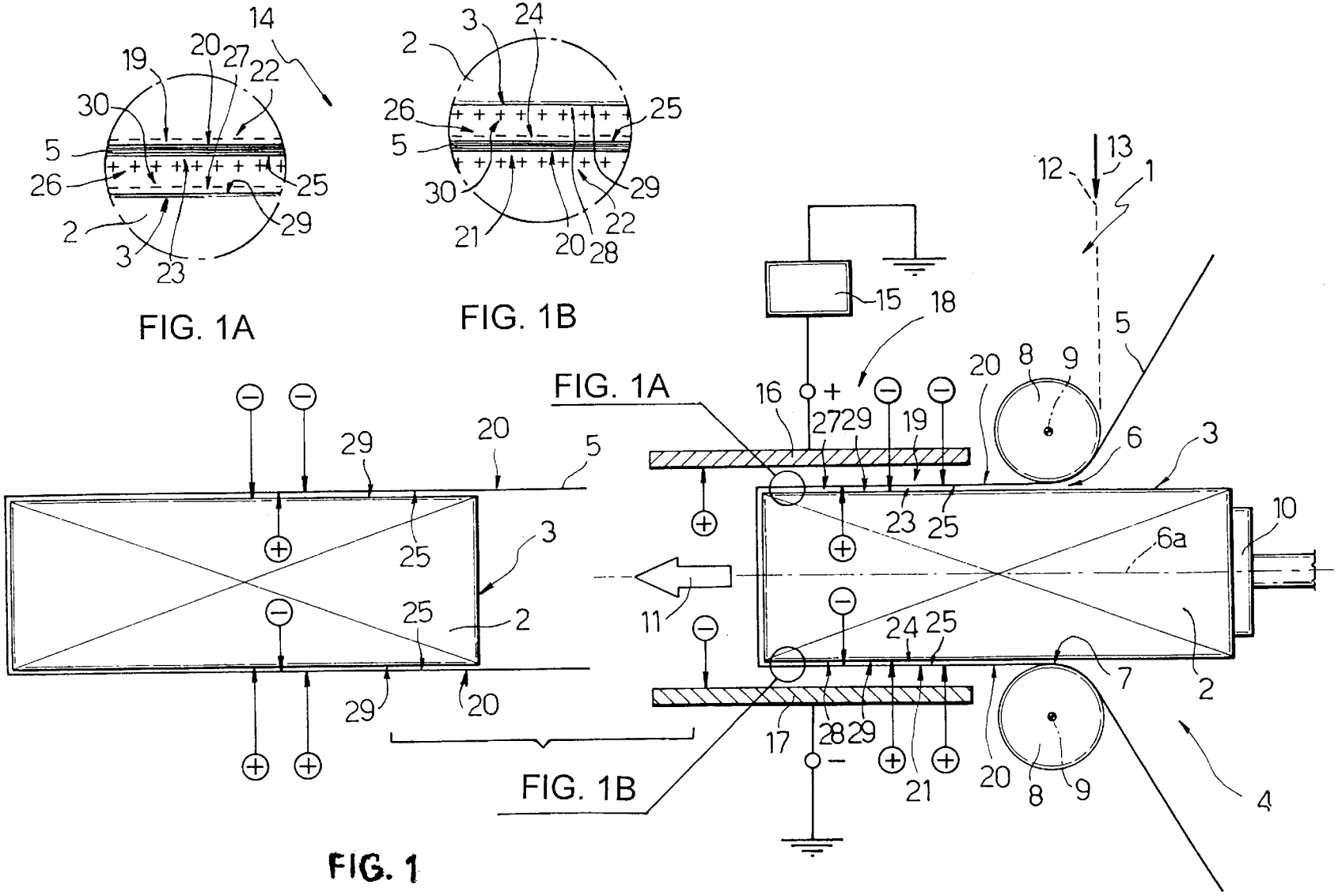
FIGS. 1, 1A, 1B shows a schematic side view, with parts in section and parts removed for clarity, of an overwrapping machine implementing the method according to the present invention.

Number 1 in FIG. 1 indicates an overwrapping machine, in particular a cellophaning machine, for overwrapping products 2 comprising, in the example shown, packets or cartons of cigarettes, each having an outer wrapping 3 made of dielectric material.

Machine 1 comprises a folding device 4 for folding a sheet 5 of dielectric wrapping material (normally polypropylene) into a U about each product 2, and which in turn comprises a passage or channel 6 having a longitudinal axis 6*a* and an inlet opening 7 lying in a plane perpendicular to axis 6*a*. Opening 7 is defined laterally, by way of example, by two rollers 8 made of dielectric material and mounted for rotation about respective axes 9 parallel to each other and crosswise to axis 6*a*. Machine 1 also comprises a known product supply device 10 for successively feeding products 2 through opening 7 of channel 6 in a direction 11 parallel to axis 6*a*; and a known supply line 12 for successively feeding sheets 5 of wrapping material in a direction 13 perpendicular to direction 11 and crosswise to axes 9, and for arresting each sheet 5 at opening 7.

Machine 1 also comprises a stabilizing device 14, in turn comprising an electric generator 15, and two electrically conductive plates 16 and 17 extending parallel to each other and to axes 9 and direction 11, and located on either side of axis 6*a*, adjacent to rollers 8, so as to define two opposite lateral walls of channel 6. Plates 16 and 17 are connected respectively to a positive and a negative pole of generator 15 to define the opposite plates of a capacitor 18 for generating an electric field through channel 6.

In actual use, a sheet 5 and a respective product 2 are fed in time with each other up to opening 7 by line 12 and device 10 respectively. As of this position, when product 2 is moved in direction 11 by device 10, one end of product 2 contacts sheet 5, which, together with product 2, is inserted through opening 7 into channel 6 and, in contact with the periphery of rollers 8, is gradually folded into a U about product 2. Rollers 8 may be powered to rotate in opposite directions, and so that each roller 8 rotates, in contact with a respective portion of sheet 5, in the opposite direction to direction 11.

As the sheet is gradually folded into a U, product 2 and respective sheet 5 gradually enter the electric field generated by capacitor 18, and sheet 5 is positioned with a first portion 19 of its outer surface 20 facing and adjacent to plate 16, and with a second portion 21 of surface 20 facing and adjacent to plate 17. Said electric field induces, on portions 19 and 21, surface electric charges 22 opposite in sign to the electric charges distributed on respective adjacent plates 16 and 17. At the same time, the electric field induces, on portions 23 and 24 of an inner surface 25 of sheet 5, electric charges 26 opposite in sign to the electric charges 22 distributed on corresponding portions 19 and 21 of surface 20. And at the same time, the electric field induces, on portions 27 and 28 of an outer surface 29 of product 2, electric charges 30 opposite in sign to the electric charges 26 distributed on the corresponding portions 23 and 24 of surface 25.

Being opposite in sign and attracting each other, charges 26 and 30 provide for substantially vacuum connecting sheet 5 to product 2, for stabilizing sheet 5 in the U-folded position about product 2, and for ensuring sheet 5 adheres perfectly to product 2 for a certain length of time and in the absence of an electric field, with no need for any type of external retaining element.

Figure 2:
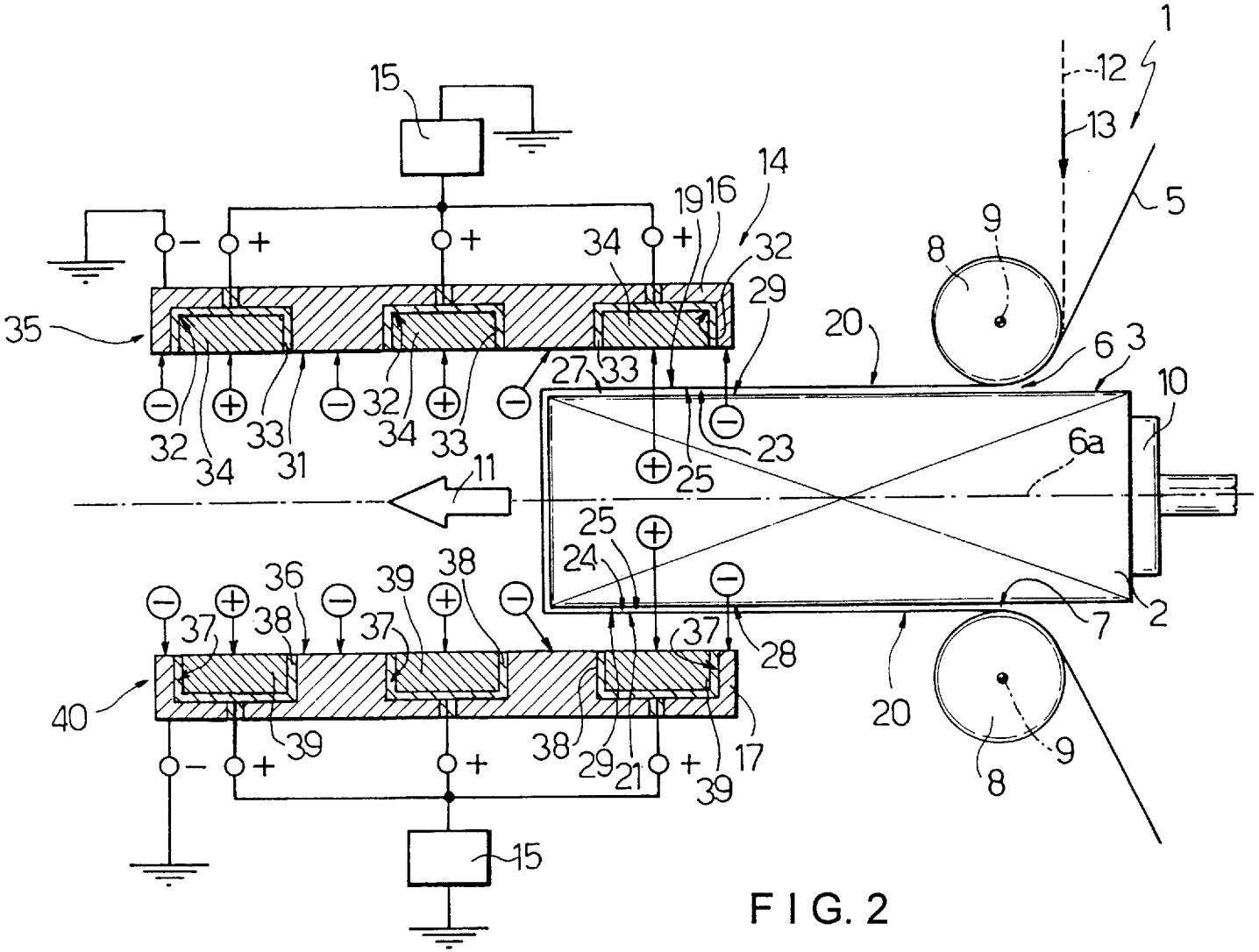
FIG. 2 shows a schematic side view, with parts in section and parts removed for clarity, of a variation of the FIG. 1 machine.

In the FIG. 2 variation, the outer surface 31 of plate 16 facing plate 17 comprises a number of seats 32, each having a lining 33 of electrically insulating material, and each housing a respective pad 34 made of electrically conducting material and with its outer surface coplanar with surface 31. Plate 16 and pads 34 are respectively connected to the negative pole of a respective generator 15 and to the positive pole of generator 15, and define a first capacitor 35 for generating an electric field close to surface 31 of plate 16.

Similarly, the outer surface 36 of plate 17 facing plate 16 comprises a number of seats 37, each having a lining 38 of electrically insulating material, and each housing a respective pad 39 made of electrically conducting material and with its outer surface coplanar with surface 36. Plate 17 and pads 39 are respectively connected to the negative pole of a respective generator 15 and to the positive pole of generator 15, and define a second capacitor 40 for generating an electric field close to surface 36 of plate 17.

According to a variation not shown, plates 16 and 17 are dispensed with, and the poles of generator 15 are connected to rollers 8, which, in this case, are made of electrically conducting material.

According to a further variation not shown, plates 16 and 17 and generator 15 are dispensed with, and rollers 8 are drive rollers made at least externally of a material for generating electric charges 22 on sheet 5 by triboelectrification or frictional electricity.

In which case, said electric field is a local electric field generated by charges 22, and which induces, on surface 29 of product 2, charges 30 opposite in sign to charges 22.

We claim:

1. A method of wrapping a product (2) made at least externally of dielectric material, the method comprising the step of folding a sheet (5) of dielectric wrapping material into a U about said product (2), and being characterized by comprising a stabilizing step for stabilizing the sheet (5) in the U-folded position; said stabilizing step being performed by generating an electrostatic force of attraction between the sheet (5) and an outer surface (29) of the product (2).

2. A method as claimed in claim 1, characterized in that said force is generated by forming a first given distribution (26) of electric charges on said sheet (5), and a second distribution (30) of charges of opposite sign on the outer surface (29) of the product (2).

3. A method as claimed in claim 2, characterized in that said distributions (26, 30) of electric charges are formed by induction, by placing the product (2) and the sheet (5) inside an electric field; said first distribution (26) of charges being formed on an inner surface (25) of the sheet (5).

4. A method as claimed in claim 3, characterized in that said electric field is formed by means of two plates (16, 17) made of electrically conducting material and located on either side of a path (11) of the product (2); said plates (16, 17) forming the plates of a capacitor (18).

5. A method as claimed in claim 3, characterized in that said electric field is formed by means of two plates (16, 17) located on either side of a path (11) of the product (2); each said plate (16; 17) being made of electrically conducting material, and having at least one seat (32; 37) for housing a pad (34; 39) of electrically conducting material via the interposition of a layer (33; 38) of dielectric material; and said plate (16; 17) and the respective pad (34; 39) being connected to opposite poles of an electric generator (15) to define respective plates of a capacitor (35; 40).

6. A method as claimed in claim 2, characterized in that said first (26) and second (30) distributions of electric charges are formed by depositing charges on said sheet (5).

7. A method as claimed in claim 6, characterized in that said first distribution (26) of charges is formed on an outer surface (20) of said sheet (5).

8. A method as claimed in claim 1, characterized in that said sheet (5) of wrapping material is a sheet (5) of overwrapping material; said product (2) comprising an outer wrapping (3) of dielectric material.

9. A method as claimed in claim 1, characterized by comprising the steps of feeding said sheet (5) past an opening (7) of a passage (6) for said product (2); feeding the product (2) to be overwrapped into engagement with the sheet (5) and subsequently, together with the sheet (5), through said passage (6) to fold the sheet (5) into a U about the product (2); and stabilizing the sheet (5) so folded by feeding the sheet (5) and the product (2) through an electric field.

10. A method as claimed in claim 9, characterized in that the product (2) and the respective sheet (5) are fed through said electric field as they emerge from said passage (6).

* * * * *